US006354734B1

(12) United States Patent
Curran et al.

(10) Patent No.: US 6,354,734 B1
(45) Date of Patent: Mar. 12, 2002

(54) APPARATUS FOR ACCURATE TEMPERATURE AND PRESSURE MEASUREMENT

(75) Inventors: Christopher John Curran; Paul Frederick Kent, both of Houston; Robert Tyler, Sugar Land; Iain Robert McFarlane, Houston, all of TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 09/434,419

(22) Filed: Nov. 4, 1999

(51) Int. Cl.[7] ..... G01K 1/08; G01L 607/00

(52) U.S. Cl. ..... 374/148; 73/442; 73/730; 374/143; 374/138

(58) Field of Search ..... 374/135, 142, 374/143, 148, 208, 138; 73/152.01, 152.22, 152.27, 152.18, 153.33, 152.51, 23.27, 23.29, 28.03, 31.04, 442, 37, 730, 708

(56) References Cited

U.S. PATENT DOCUMENTS 2,645,128 A * 7/1953 Walker et al.
3,572,121 A * 3/1971 Kesseru et al.
3,712,129 A * 1/1973 Rhoades ..... 73/151
3,895,527 A * 7/1975 McArthur ..... 73/151
3,898,877 A * 8/1975 McArthur ..... 73/151
4,010,642 A * 3/1977 McArthur ..... 73/151
4,483,195 A * 11/1984 Brown et al. ..... 73/702
4,633,213 A * 12/1986 Venema ..... 340/60
4,689,999 A * 9/1987 Shkedi ..... 73/708
4,721,533 A * 1/1988 Phillippi et al. ..... 374/208
4,763,527 A * 8/1988 Raftis ..... 73/730
4,837,777 A * 6/1989 Jones et al. ..... 374/142
5,000,580 A * 3/1991 Leininger et al. ..... 374/130
5,163,321 A * 11/1992 Perales ..... 374/137
5,271,675 A * 12/1993 Fagan et al. ..... 374/110
5,879,082 A * 3/1999 Smitherman et al. ..... 374/110
5,925,815 A * 7/1999 Jones et al. ..... 73/25.03
6,022,139 A * 2/2000 Kil ..... 374/142
6,062,087 A * 5/2000 Vovan ..... 73/726
6,147,437 A * 11/2000 Matsumoto et al. ..... 310/338
6,158,276 A * 12/2000 Patey et al. ..... 73/152.18
6,164,126 A * 12/2000 Ciglenec et al. ..... 73/152.01

* cited by examiner

*Primary Examiner*—Diego Gutierrez
*Assistant Examiner*—Gail Verbitsky
(74) *Attorney, Agent, or Firm*—Buskop Law Group, P.C.; Wendy K. Buskop

(57) ABSTRACT

An apparatus for accurate temperature and pressure measurement in production processes is described. In designing the temperture pressure probe, novel features are described which include minimization of the thermal mass of the thermal probe, thermal isolation of the thermal probe from its surroundings, and generating turbulence in the vicinity of the thermal probe where it comes in contact with the fluid flow. Embodiments disclosed for the pressure sensor include a recessed position where fluid pressure transients are minimized, and a surface mounted pressure sensor that is useful where the pressure sensor of the first embodiment is likely to get clogged due to fluid composition.

77 Claims, 3 Drawing Sheets

APPARATUS FOR ACCURATE TEMPERATURE AND PRESSURE MEASUREMENT

BACKGROUND OF THE INVENTION

The present invention relates to measuring and monitoring fluid flow parameters and more particularly to measurement of fluid temperature and pressure accurately and reliably in a wellbore of an oil, gas, or geothermal well.

The accurate measurement of wellbore fluid temperature and pressure has been recognized as being important in the production of oil, gas, and geothermal energy. Often the fluid flow around the temperature or pressure probes, specially in deep boreholes, does not come in reasonably complete contact with the probe due to Bernoulli effect and/or debris settlement near the probes. Another reason that fluid flow contact with the probe is diminished is that generally the probe dimensions are large enough to act as a heat sink; thus, reducing the temperature of the surrounding fluid media. As a consequence temperature and pressure measurements are not accurate. Hydrocarbon exploration, production and secondary hydrocarbon recovery operations, and geothermal operations require temperature and pressure data to determine various factors considered in predicting the success of the operation, and in obtaining the maximum recovery of energy from the wellbore.

In hydrocarbon exploration and recovery operations, borehole temperature and pressure measurements are two of the key parameters that give indications of a well's productivity potential. Therefore, accurate measurement of borehole temperature and pressure is of paramount importance. The accurate measurement of temperature and pressure changes in well fluids from various boreholes into a formation provides indication of the location of injection fluid fronts, and the efficiency with which the fluid front is sweeping the formation.

Numerous techniques comprising of lowering sensors into the borehole at desired location have been devised for periodic measurement of wellbore temperature and pressure. Such periodic measurement techniques are inconvenient and expensive because of the time and expense involved for inserting the necessary instrumentation into the borehole. Moreover, such periodic measurement techniques are limited in scope because they provide only a representation of borehole parameters at specific times, while measurements over an extended period are desirable. Ideally, continuous monitoring of the parameters is needed by the operator. For example U.S. Pat. No. 3,712,129, teaches charging an open-ended tube with a gas until it bubbles from the bottom of the tube in order to provide the desired periodic pressure measurement.

Permanent installation techniques have been devised for continuous monitoring pressure in a borehole so as to alleviate the problems associated with periodic measurements. In one such prior art a wellbore pressure transducer and a temperature sensor having electronic scanning ability for converting detected wellbore pressures and temperatures into electronic data is installed at the location of interest in the wellbore. The measurement data is transmitted to the surface on an electrical wire. The electrical wire is attached to the outside of the tubing in the wellbore, and the pressure transducer and temperature sensor are mounted on the lower end of the production tubing. This system has not been well accepted in the industry, partially because of the expense and high maintenance of the surface electronics required over an extended period of time. The reliability of the wellbore electronics is considerably reduced in high temperatures, pressures and corrosive fluid environment in the wellbore that substantially increases the expenses. U.S. Pat. No. 3,895,527 teaches a system for remotely measuring pressure in a borehole utilizing a small diameter tube whose one end is exposed to borehole pressure and the other end is coupled to a pressure gauge or other pressure detector located at the surface. U.S. Pat. No. 3,898,877, discloses a system of measuring wellbore pressure which uses a small diameter tube, and an improved version of such a system is disclosed in U.S. Pat. No. 4,010,642. The teachings of '642 patent have considerably improved the technology of measuring pressure in a borehole, because the lower end of the tube extends into a chamber having at least a desired fluid volume. However, teachings of patent '642 do not disclose measurement of both temperature and pressure at the desired location in the wellbore. An operator may be able to estimate wellbore fluid temperature by extrapolating from assumed temperature gradient data and pressure measurements taken at the surface, and/or by estimating an average temperature for the borehole from previously obtained drilling data. The estimated temperature may be used to determine a test fluid correction factor, which may then be applied to more accurately determine the wellbore pressure. It is long recognized, however, that still accurate temperature information is not being obtained, and therefore, the correction of pressure readings based on inaccurate temperature estimates results in errors in the pressure readings obtained by the technique of utilizing such a small diameter tube.

In addition to inaccuracy of the extrapolated temperature, the true temperature within a well varies with wellbore depth and, gas release and/or "freezing" and other variations that may occur at particular depths. As a consequence wellbore temperature or pressure in most boreholes cannot be reliably and economically measured, and one cannot maximize recovery of energy from the borehole. U.S. Pat. No. 5,163,321 patent teaches a system which comprises a single small diameter tubing extending from the surface of the well to the desired wellbore test location. Pressure at the location of the tube end in the wellbore is then extrapolated by the corresponding surface reading. A thermocouple at the same location measures the temperature and is conveyed to the surface by means of a wire or by fiber optic means. Apparently, reliance on extrapolation of the pressure data obtained at the surface to determine pressure at the specific location in the wellbore makes the measurements inaccurate. Furthermore, the temperature measurement at the location of interest is subject to temperature anisotropy caused by the fluid flow. The temperature at the location of interest varies because of fluid emanating from different parts of the wellbore, and also due to pressure differential around the probe because of Bernoulli effect, resulting in poor fluid contact with the probe.

An innovative temperature and pressure sensing device is described in this invention that overcomes aforementioned deficiencies of inadequacy of good fluid contact with the sensor and uniformity of the fluid contact with the sensor. The disclosed temperature and pressure sensing device can be used for continuous monitoring of the temperature and pressure in locations where accurate measurements in flowing fluid is desired.

SUMMARY OF THE INVENTION

A temperature sensing device removably disposed in conduit means which provides fluid flow in a production process comprising a temperature sensor capable of detecting temperature in the fluid flow comprising a face having a surface roughness capable of providing turbulence to the fluid flow, wherein the face with surface roughness is made of thermally conductive material; a temperature probe in thermal connection with the face; and a thermal insulating barrier surrounding the temperature probe and connected to the face, the thermal insulating barrier containing a passageway for providing signaling means; a tubular member containing passageway continuing from the thermal insulating barrier for providing signaling means, the tubular member connected to the insulating barrier; signaling means disposed in the passageway of the tubular member for communicating the temperature detected by the temperature probe to a remote monitoring device; thermal insulating means disposed around the tubular member; and connecting means for detachably connecting the thermal insulating barrier to the insulating means.

DETAILED DESCRIPTION OF PREFERRED EMBODIMENTS

Figure 1:
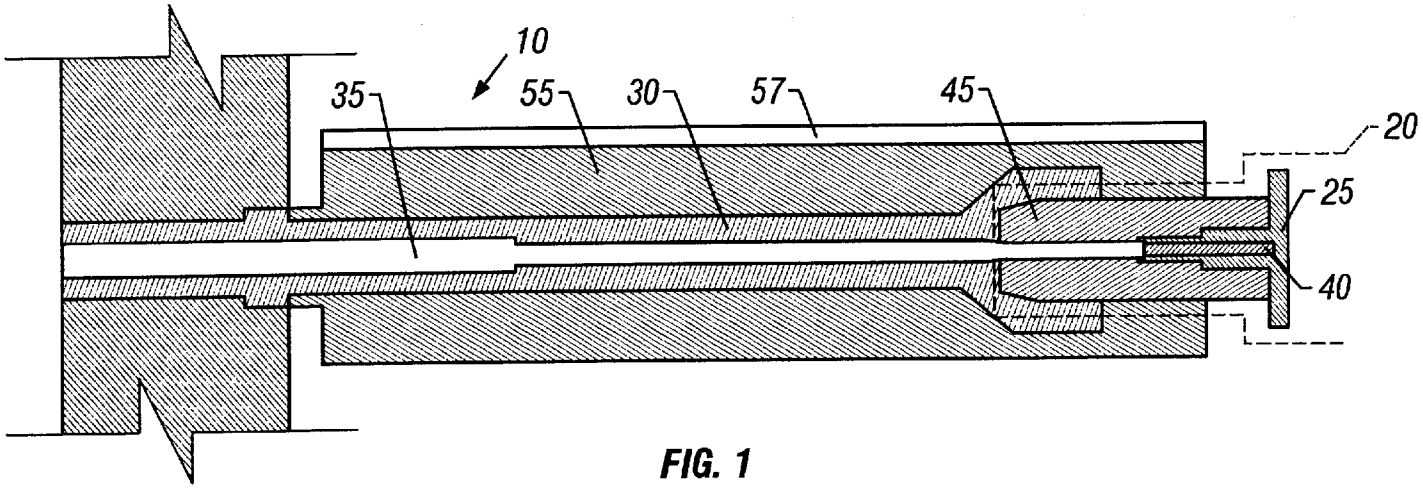
FIG. 1 is a cross sectional view of the temperature and pressure sensing device.

FIG. 1 is a cross sectional view of a temperature and pressure sensing device 10 (hereafter referred to as the device 10). Now referring to FIGS. 1–4, the device 10 includes of a temperature sensor 20 that is designed to measure temperature in a flowing fluid medium in a production process. The temperature sensor 20 has a face 25, a temperature probe 40, and a thermal insulating barrier 45 surrounding the temperature probe 40 that is connected to the face 25. The thermal insulating barrier 45 contains a passageway 35 for providing signaling means 50. There is a tubular member 30 containing passageway 35 that is continuing from the thermal insulating barrier 45 for providing signaling means 50. The tubular member 30 is connected to the insulating barrier 45. A signaling means 50 is disposed in the passageway 35 for communicating the temperature and pressure signals detected by the temperature probe 40 and a pressure sensor (not shown) disposed in a pressure channel 70 to a remote monitoring device (FIGS. 6A and 6B) located at the surface or any other desired location. A thermal insulating means 55 is disposed around the tubular member 30. Connecting means 60 are provided for detachably connecting the thermal insulating barrier 45 to the insulating means 55. Assembly of the face 25, the temperature probe 40, and the thermal insulating barrier 45 (that makes up the temperature sensor 20) is connected through the tubular member 30 to the thermal insulating means 55 by the connecting means 60.

Figure 3:
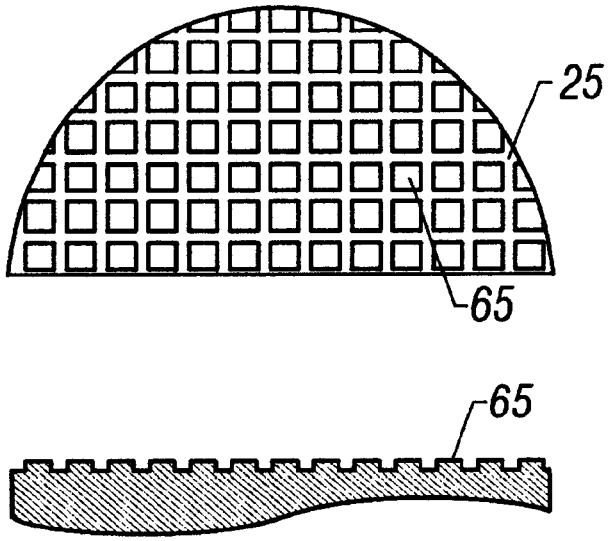
FIG. 3 is a plan view of a cross section of the innovative face of the temperature and pressure sensing device.

The face 25 has a surface roughness 65 that is designed to provide turbulence to the fluid flow. The face 25 is made of a thermally conductive material. In the preferred embodiment the face 25 is made of a metal. The choice of metal is dictated by its thermal mass, thermal conductivity, survivability in the operating environment, and fabrication. The face 25 in one of the embodiments is a circular disc made of Inconel. Inconel was selected because it is highly thermally conductive and is also resistant to highly corrosive environment like that are encountered in a borehole. However, one can adapt any shape and size for the face 25 to suit the requirements of geometry in a particular operation. Also, the face 25 need not necessarily be circular because a different shape can be adapted to suit the requirements on hand. One side of the face 25 that comes in contact with the fluid has a grid pattern designated as the surface roughness 65 as shown in FIG. 3. The surface roughness 65 is designed to enhance turbulence in the fluid in the vicinity of the face 25 so that fluid stirring action is achieved. Thus, the face 25 comes in contact with fluid of nearly true average temperature of the flowing fluid thereby considerably improving accuracy of the sensed temperature. Numerous grid patterns or surface treatment, like sand blasting, for the surface roughness 65 can be adopted to achieve desired turbulence in the fluid. Thickness of the face 25 can range between 0.05 and 0.3 inches, and the diameter can be selected to suit the operating environment and convenience of fabrication. However, the thermal mass of the face 25 should be kept low so that temperature of the fluid coming in contact with the face 25 is minimally impacted. In one of the preferred embodiments the face 25 has a diameter of 1.5 inches, a thickness of 0.18 inch, and a depth of the surface roughness 65 of 0.02 inch.

The face 25 is thermally coupled to the temperature probe 40 wherein the two components are in physical contact. The temperature probe 40 and the face 25 are in direct physical contact to provide thermal coupling. The temperature probe 40 may be positioned vertically with respect to the surface of the face 25, as shown in FIG. 1, or may be positioned horizontally with respect to the surface of the face 25, wherein the objective is to maximize thermal coupling between the face 25 and the temperature probe 40. In one of the preferred embodiment the temperature probe 40 is a resistance temperature device (RTD) like platinum resistance thermometer. Other temperature probes or temperature sensing elements are commonly available in the market. Such temperature sensing elements use various technologies like thermocouple, thermistor, infrared temperature sensing and other solid state temperature sensing elements. Any of the sensing element may be used depending on suitability in its operating environment. Temperature sensing elements in numerous sensing ranges are available in the market so that one can select the sensing clement in the desired range. In one of the embodiments the temperature probe 40 has a temperature sensing range of −58° F. to 302° F. (−50° C. to 150° C.).

Referring to FIG. 1 again, the temperature probe 40 is positioned in the thermal insulating barrier 45 containing the passageway 35 for providing path for the signaling means 50. The passageway 35 extends through the tubular member 30 to provide a continued connection path for the signaling means 50, from the temperature probe 40 to the monitoring means and the recording means located at a remote site. The face 25 is sealingly attached to the thermal insulating barrier 45. The thermal insulating barrier 45 in a preferred embodiment is made of a ceramic thermal insulating material or a polymeric thermal insulating material. PEEK, which term means polyether ether ketone, is a preferred material to be used as an insulating material with extremely low thermal conductivity and is tolerant of corrosive environment in which the device 10 is intended to operate. Other suitable materials with low thermal conductivity and tolerance for corrosive environment that can be used for different operating environments are: zirconia, PTFE, which term means polytetrafluoroethylene, any member of the family of elastomeric thermal insulating materials, any member of the family of polymeric insulating materials, and combinations thereof.

Assembly of the face 25, the temperature probe 40, and the thermal insulating barrier 45 is securely and sealingly held in the tubular member 30 as shown in FIG. 1. In a preferred embodiment the tubular member 30 is constructed to have three inner diameters for adapting the temperature sensor 20, and the signaling means 50 passing through the passageway 35. The first inner diameter (near the temperature sensor 20) is in the range 0.5–0.75 inches, next the second inner diameter is in the range 0.125–0.375 inches, and the third inner diameter is in the range 0.375–0.5 inches as shown in FIG. 1. The passageway 35 provides a path for the signaling means 50 to carry measured temperature and pressure signals from the device 10 to the surface or a remote site. The tubular member 30 is made of such a metal that can provide strength to the assembly, and can withstand corrosive environment of the intended operation. The tubular member 30, in a preferred embodiment is made of stainless steel. The outer diameter of the tubular member 30 can range between 3.5 to 0.5 inch depending upon the type of application it is going to be used in.

The thermal insulating means 55 is disposed around the tubular member 30. The thermal insulating means 55 thermally isolates the temperature sensor 20 from the conduit means 57 in which the device 10 is installed. The thermal insulating means 55 is made of an insulating polymeric material, an insulating elastomeric material, or an insulating ceramic material. PEEK is considered the best embodiment for the insulating means 55. Same considerations in selecting materials for the thermal insulating means 55 apply as for selecting materials for the thermal insulating barrier 45. Other suitable materials with low thermal conductivity and tolerance for corrosive environment that can be considered for different operating environments are: zirconia, PTFE, family of insulating elastomeric materials, and family of insulating polymeric materials. In a preferred embodiment the thermal insulating means 55 is designed as a two equal parts of a sleeve. This design of the thermal insulating means 55 is convenient to manufacture and assemble.

Figure 2:
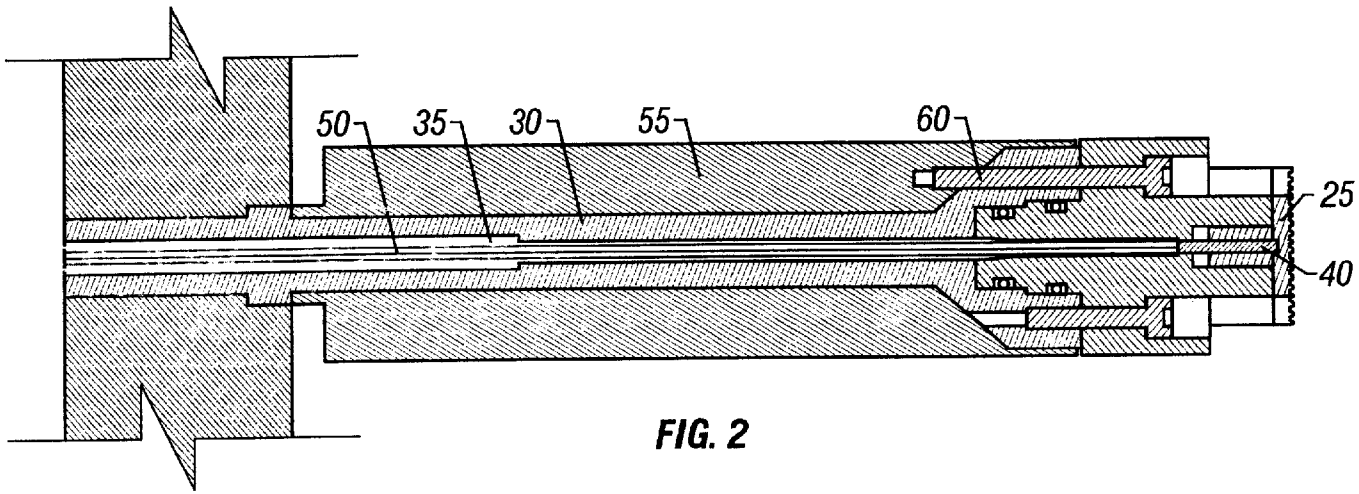
FIG. 2 is a cross sectional view of the temperature and pressure sensing device including the signaling means and connecting means for the temperature and pressure sensor.
Figure 4:
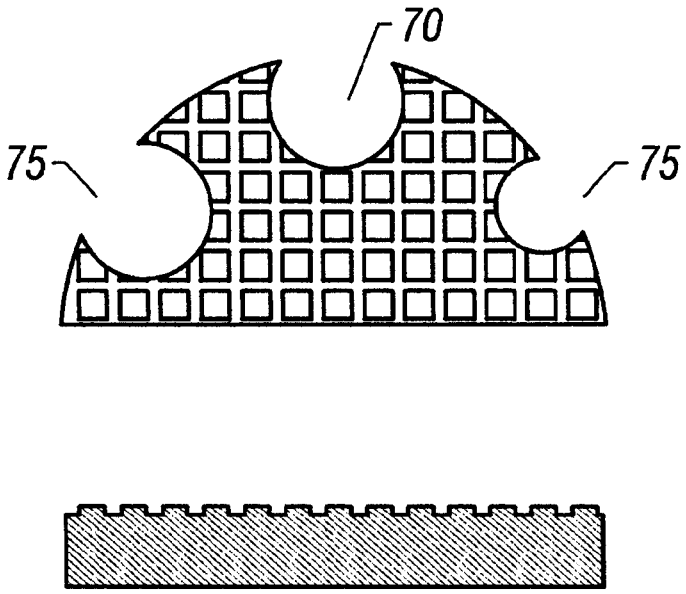
FIG. 4 is a plan view and cross section of the innovative face of the temperature and pressure sensing device.

The connecting means 60 can be bolts, screws, clips, threaded means, bonding materials, adhesive materials or any other attaching materials. In a preferred embodiment, bolts are used to connect the assembly of the face 25, the temperature probe 40, and the thermal insulating barrier 45 through the tubular member 30 to the thermal insulating means 55 as shown in FIG. 2. However, it is contemplated that the connecting means 60 could be omitted and the metal parts of the probe could be welded together. The assembly is provided with four bolt holes 75 passing through the face 25 and the thermal insulating barrier 45 as shown in FIG. 4. Two bolts are used to hold each part of the sleeve of the thermal insulating means 55 to the assembly. However, other means and methods of attaching as described above may be used to attach the face 25 to the thermal insulating means 55. The bolt holes 75 have an added advantage that they further enhance turbulence in the flowing fluid media thereby improving the fluid stirring action and thus aiding in improving the accuracy of temperature measurements.

Figure 5:
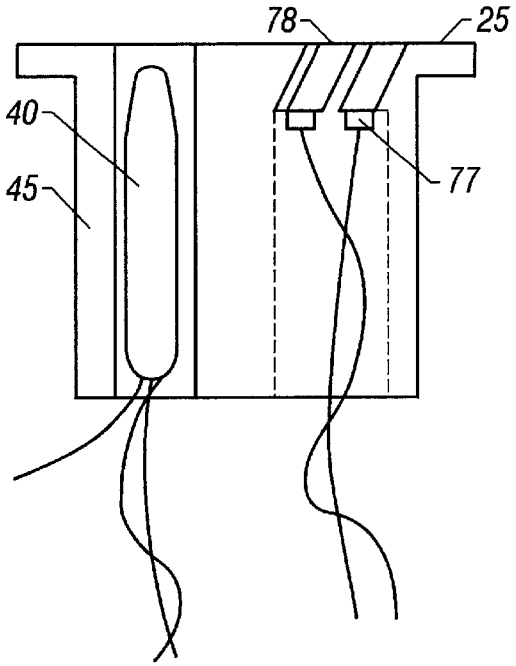
FIG. 5 is a partial cross sectional view of the temperature and pressure sensing device with a face mounted pressure sensor.

Referring to FIG. 4 again, the face 25 is further provided with at least one pressure channel 70 through which the flowing fluid reaches to a pressure sensor (not shown). The pressure sensor is recessed in the pressure channel 70. Since the pressure sensor is located in a recessed location, the pressure transients in the fluid flow are damped out at the location of the pressure sensor. The pressure sensor is connected by the signaling means 50 to the display means and recording means located at the surface. Referring to FIG. 5, in a second embodiment of the invention a surface mount pressure sensor 77 mounted the face 25. The pressure sensor 77 and the face 25 are electrically insulated from each other. The pressure sensor 77 is film type sensor that converts pressure changes to electrical signals that are transmitted to the remote site by the signaling means 50. Pressure sensors of the described type are commonly available in the market, for example, from OMEGA corporation of Connecticut. This embodiment of the invention is preferable where the fluid flow contains components that can block the pressure channel 70 over a period of time. The pressure sensor measurements can be conveyed to the surface in analogous manner to the temperature signals as described below.

Figure 6:
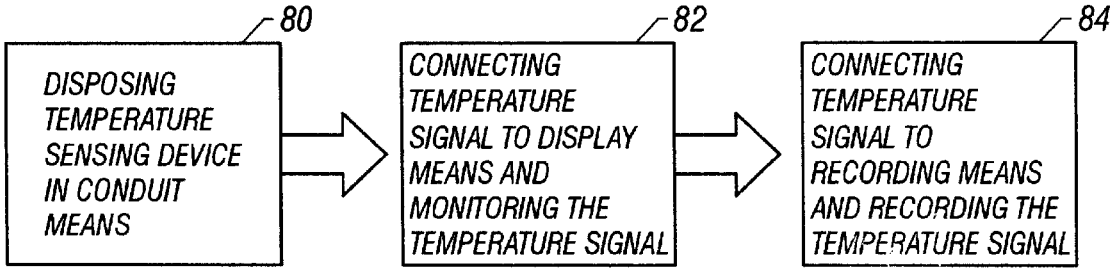
FIG. 6A is a schematic of the method of monitoring temperature using the invention.
FIG. 6B is a schematic of the method of monitoring pressure using the invention.
Figure 7:
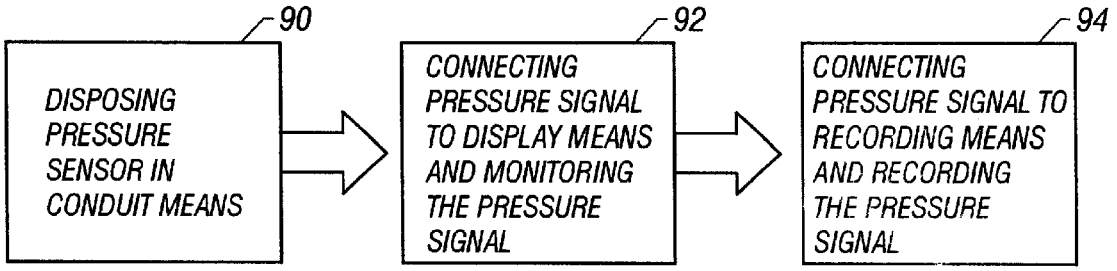

As described above the face 25 is connected to one end of the tubular member 30. FIG. 6 shows a schematic of the method of monitoring temperature using the invention. Referring to FIG. 6, in the first step 80, the device 10 is disposed in the conduit means 57. The second step 82 includes connecting temperature signal from the temperature probe 40 to display means and monitoring the temperature signal. The last step 84 includes connecting temperature signal from the temperature probe 40 with temperature sensor 20 to recording means and recording the temperature signal. Alternately, the temperature signal can be directly connected to the recording means and the temperature signal can be recorded without going through the display means. Similarly, FIG. 7 shows a schematic of the method of monitoring pressure using the invention. Referring to FIG. 7, the first step 90, the device 10 is disposed in the conduit means 90. The second step 92 includes connecting pressure signal from the pressure probe 78 (or the pressure probe located recessively in the pressure channel 70) to display means and monitoring the pressure signal The last step includes connecting the pressure signal from the pressure probe 78 to recording means and recording the pressure signal 94. Alternately, the pressure signal can be directly connected to the recording means and the pressure signal can be recorded without going through the display means. The signaling means 50 connect the temperature probe 40 and the pressure sensor through the passageway 35 to the monitoring and/or recording means on the surface or on a site of choice. The signaling means 50 can be conductive wires including coaxial cables, fiber optics means including necessary means for conversion of signals for transfer and signal recovery through fiber optics means, radio signals, and any combination thereof.

The device 10 can be used where the fluid flow is liquid flow, gas flow, particulate flow, or a combination thereof. The particulate flow is typically encountered where sand, drill cuttings, drilling mud and precipitates are present in varying degrees of concentration in production processes. The device 10 is useful in any production process or laboratory where accurate temperature and/or pressure measurements are critical, for example in surface oil and/or gas exploration, surface oil and/or gas production, underwater oil and/or gas exploration, underwater oil and/or gas production, petroleum refinery operations, chemical manufacturing plants, fluid custody transfer, and fluids in tank farms.

It should be noted that in design of the device 10 the face 25 has a thermal contact with only the temperature probe 40. By skillful design of the device 10, all other thermal paths from the face 25 and the temperature probe 40 have been isolated by the thermal insulating barrier 45 and the thermal insulating means 55. This design reduces thermal losses of the fluid under measurement to the device 10 to a very low level and thereby improves accuracy of the temperature measurements.

To use the device 10, the face 25 is disposed in the fluid through the wall of the conduit carrying the fluid flow. The device 10 is secured so that there is no leakage of the fluid through the wall of the conduit. In a preferred embodiment the disk thickness of the face 25 is 0.18 inch. Thus only about 0.18 inch penetration of the device 10 in the fluid flow is required to obtain desired measurements. Such a minimal intrusion of the device 10 in the fluid flow is highly desirable to maintain the natural flow of the fluid. A combination of low thermal mass of the face 25, a minimal intrusion of the face 25 in the fluid flow, and fluid stirring action provided by the surface roughness 65 on the face 25 results in substantially improved accuracy of the temperature measurements. As described above, one end of the signaling means 50 is connected to the temperature probe 40 and the pressure sensor 77, and the output end of the signaling means 50 is connected to the monitoring and/or recording means located at the surface. The temperature and pressure output signals can be displayed on CRT display screen, liquid crystal display screen, printer, projection display screen, or combinations thereof. The temperature and pressure output signals can be recorded on magnetic media, printed media, optical media, electronic media, or on a combinations thereof. The displayed output signals can be processed in real time for immediate actions or at a later time for analysis.

What is claimed is:

1. A temperature sensing device removably disposed in conduit means which provides fluid flow in a production process comprising:

(a) a temperature sensor capable of detecting temperature in said fluid flow comprising:
  (i) a face having a surface roughness capable of providing turbulence to said fluid flow, wherein said face with surface roughness is made of thermally conductive material;
  (ii) a temperature probe in thermal connection with said face; and
  (iii) a thermal insulating barrier surrounding said temperature probe and connected to said face, said thermal insulating barrier containing a passageway for providing signaling means;

(b) a tubular member containing passageway continuing from said thermal insulating barrier for providing signaling means, said tubular member connected to said insulating barrier;

(c) signaling means disposed in said passageway of said tubular member for communicating the temperature detected by said temperature probe to a remote monitoring device;

(d) thermal insulating means disposed around said tubular member; and (e) connecting means for detachably connecting said thermal insulating barrier to said insulating means.

2. The temperature sensing device described in claim 1, wherein said surface roughness of said face is a grid pattern disposed on said face.

3. The temperature sensing device described in claim 1, wherein said thermally conductive material is a metal.

4. The temperature sensing device described in claim 3, wherein said metal is Inconel.

5. The temperature sensing device described in claim 1, wherein said face is between 0.05 inches and 0.5 inches thick.

6. The temperature sensing device described in claim 1, wherein said tubular member is a metal.

7. The temperature sensing device described in claim 6, wherein said tubular member is a stainless steel.

8. The temperature sensing device described in claim 1, wherein said conduit means is selected from the group comprising: a wellbore, a pipe, a manifold, a subsea piping, a surface piping, a subsea tree block, a subsea christmas tree, a spool, a riser, a flow line, and a blowout protector.

9. The temperature sensing device described in claim 1, wherein said production process comprises: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank fan, and mixtures thereof.

10. The temperature sensing device described in claim 1, wherein said thermal insulating means is a member of the group comprising: ceramic insulating materials, elastomeric insulating materials, polymeric insulating materials, and combinations thereof.

11. The temperature sensing device described in claim 1, wherein said thermal insulating barrier is a member of the group comprising: ceramic insulating materials, elastomeric insulating materials, polymeric insulating materials, and combinations thereof.

12. A temperature and pressure sensing device removably disposed in conduit means which provides fluid flow in a production process comprising:

(a) a temperature sensor capable of detecting temperature in said fluid flow comprising:
  (i) a face having a surface roughness capable of providing turbulence to said fluid flow, wherein said face with surface roughness is made of thermally conductive material;
  (ii) a temperature probe in thermal connection with said face; and
  (iii) a thermal insulating barrier surrounding said temperature probe and connected to said face, said thermal insulating barrier containing a passageway for providing signaling means;

(b) a tubular member containing passageway continuing from said thermal insulating barrier for providing signaling means, said tubular member connected to said insulating barrier;

(c) a pressure sensor capable of detecting pressure in said fluid flow comprising a pressure probe disposed on said face and in fluid connection with said fluid flow wherein said pressure probe is electrically insulated from said face;

(d) signaling means disposed in said passageway of said tubular member for communicating the temperature detected by said temperature probe and communicating the pressure detected by said pressure probe to a remote monitoring device;

(e) thermal insulating means disposed around said tubular member; and (f) connecting means for detachably connecting said face to said tubular member.

13. The temperature and pressure sensing device described in claim 12, wherein said thermally conductive material is a metal.

14. The temperature and pressure sensing device described in claim 12, wherein said conduit means is selected from the group comprising: a wellbore, a pipe, a manifold, a subsea piping, a surface piping, a subsea tree block, a subsea Christmas tree, a spool, a riser, a flow line, and a blowout protector.

15. The temperature and pressure sensing device described in claim 12, wherein said thermal insulating means is a member of the group comprising: ceramic insulating materials, elastomeric insulating materials, polymeric insulating materials, and combinations thereof.

16. The temperature and pressure sensing device described in claim 12, wherein said thermal insulating barrier is a member of the group comprising: ceramic insulating materials, elastomeric insulating materials, polymeric insulating materials, and combinations thereof.

17. The temperature and pressure sensing device described in claim 12, wherein said surface roughness is a grid pattern disposed on said face.

18. The temperature and pressure sensing device described in claim 12, wherein said thermally conductive material is metal.

19. The temperature and pressure sensing device described in claim 18, wherein said metal is Inconel.

20. The temperature and pressure sensing device described in claim 12, wherein said face is between 0.05 inches and 0.5 inches thick.

21. The temperature and pressure sensing device described in claim 12, wherein said tubular member is a metal.

22. The temperature and pressure sensing device described in claim 21, wherein said tubular member is stainless steel.

23. The temperature and pressure sensing device described in claim 21, wherein said tubular member is a stainless steel.

24. The temperature and pressure sensing device described in claim 12, wherein said tubular member has a outer diameter between 3.5 inches and 0.5 inches.

25. The temperature and pressure sensing device described in claim 12, wherein said tubular member has at least three inner diameters, a first diameter larger than a second diameter, and a third diameter larger than said second diameter.

26. The temperature and pressure sensing device described in claim 12, wherein said probe is capable of measuring temperature in the range of −58° F. to 302° F.

27. The temperature and pressure sensing device described in claim 12, wherein said conduit means is selected from the group comprising: a wellbore, a pipe, a manifold, subsea piping, surface piping, a subsea tree block, a subsea christmas tree, a spool, a riser, flow line, and a blowout preventor.

28. The temperature and pressure sensing device described in claim 12, wherein said fluid flow comprises a particulate flow, liquid flow, gas flow, or a combination flow thereof.

29. The temperature and pressure sensing device described in claim 12, wherein said production process comprises of: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

30. The temperature and pressure sensing device described in claim 12, wherein said connecting means is a member of the group comprising: bolts, screws, clips, mechanical attaching means, bonding materials, chemical attaching materials, and combinations thereof.

31. The temperature and pressure sensing device described in claim 12, wherein said thermal insulating means is a member of the group comprising: Ceramic insulating materials, elastomeric insulating materials, polymeric insulating materials, and combinations thereof.

32. The temperature and pressure sensing device described in claim 31, wherein said thermal insulating means is a member of the group comprising: PEEK, zirconia, PTFE, similar insulating materials, elastomeric materials, polymeric materials, and combinations thereof.

33. The temperature and pressure sensing device described in claim 12, wherein said thermal insulating barrier is a member of the group comprising: Ceramic insulating materials, elastomeric insulating materials, polymeric insulating materials, and combinations thereof.

34. The temperature and pressure sensing device described in claim 33, wherein said thermal insulating barrier is a member of the group comprising: PEEK, zirconia, PTFE, similar insulating materials, elastomeric materials, polymeric materials, and combinations thereof.

35. The temperature and pressure sensing device described in claim 12 wherein said signaling means is a member of the group comprising: electrically conductive wires, fiber optics, radio signals, acoustic signals, and combinations thereof.

36. The temperature and pressure sensing device described in claim 12, wherein the pressure sensor is capable of measuring pressure in the range of 0 psi to 20,000 psi.

37. The temperature and pressure sensing device described in claim 36, wherein the pressure sensor is capable of measuring pressure in the range of 0 psi to 10,000 psi.

38. The temperature and pressure sensing device described in claim 12, wherein said production process comprises: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

39. The temperature and pressure sensing device described in claim 38, wherein the at least one pressure channel is c-shaped.

40. The temperature and pressure sensing device described in claim 38, wherein said conduit means is selected from the group comprising: a wellbore, a pipe, a manifold, a subsea piping, a surface piping, a subsea tree block, a subsea christmas tree, a spool, a riser, a flow line, and a blowout protector.

41. The temperature and pressure sensing device described in claim 38, wherein said production process comprises: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

42. The temperature and pressure sensing device described in claim 38, wherein said thermal insulating means is a member of the group comprising: ceramic insulating materials, elastomeric insulating materials, polymeric insulating materials, and combinations thereof.

43. The temperature and pressure sensing device described in claim 38, wherein said thermal insulating barrier is a member of the group comprising: ceramic insulating materials, elastomeric insulating materials, polymeric insulating materials, and combinations thereof.

44. The temperature and pressure sensing device described in claim 38, wherein said tubular member has a outer diameter between 3.5 inches and 0.5 inches.

45. The temperature and pressure sensing device described in claim 38, wherein said tubular member has at least three inner diameters, a first diameter larger than a second diameter, and a third diameter larger than said second diameter.

46. The temperature and pressure sensing device described in claim 38, wherein said probe is capable of measuring temperature in the range of −58° F. to 302° F.

47. The temperature and pressure sensing device described in claim 38, wherein said conduit means is selected from the group comprising: a wellbore, a pipe, a manifold, subsea piping, surface piping, a subsea tree block, a subsea christmas tree, a spool, a riser, flow line, and a blowout preventor.

48. The temperature and pressure sensing device described in claim 38, wherein said fluid flow comprises a particulate flow, liquid flow, gas flow, or a combination flow thereof.

49. The temperature and pressure sensing device described in claim 38, wherein said production process comprises of: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

50. The temperature and pressure sensing device described in claim 38, wherein said connecting means is a member of the group comprising: bolts, screws, clips, mechanical attaching means, bonding materials, chemical attaching materials, and combinations thereof.

51. The temperature and pressure sensing device described in claim 38, wherein said thermal insulating means is a member of the group comprising: Ceramic insulating materials, elastomeric insulating materials, polymeric insulating materials, and combinations thereof.

52. The temperature and pressure sensing device described in claim 51, wherein said thermal insulating means is a member of the group comprising: PEEK, zirconia, PTFE, similar insulating materials, elastomeric materials, polymeric materials, and combinations thereof.

53. The temperature and pressure sensing device described in claim 38, wherein said thermal insulating barrier is a member of the group comprising: Ceramic insulating materials, elastomeric insulating materials, polymeric insulating materials, and combinations thereof.

54. The temperature and pressure sensing device described in claim 53, wherein said thermal insulating barrier is a member of the group comprising: PEEK, zirconia, PTFE, similar insulating materials, elastomeric materials, polymeric materials, and combinations thereof.

55. The temperature and pressure sensing device described in claim 38 wherein said signaling means is a member of the group comprising: electrically conductive wires, fiber optics, radio signals, acoustic signals, and combinations thereof.

56. The temperature and pressure sensing device described in claim 38, wherein the pressure sensor is capable of measuring pressure in the range of 0 psi to 20,000 psi.

57. The temperature and pressure sensing device described in claim 38, wherein the pressure sensor is capable of measuring pressure in the range of 0 psi to 10,000 psi.

58. A method of monitoring temperature in a production process comprising the steps of:

(a) providing a temperature sensing device removably disposed in conduit means which provides fluid flow in said production process, wherein said temperature sensing device comprises;

(i) a temperature sensor capable of detecting temperature in said fluid flow comprising:

(1) a face having a surface roughness capable of providing turbulence to said fluid flow, wherein said face with surface roughness is made of thermally conductive material;

(2) a temperature probe in thermal connection with said face; and (3) a thermal insulating barrier surrounding said temperature probe and connected to said face, said thermal insulating barrier containing a passageway for providing signaling means;

(ii) a tubular member containing passageway continuing from said thermal insulating barrier for providing signaling means, said tubular member connected to said insulating barrier;

(iii) signaling means disposed in said passageway of said tubular member for communicating the temperature detected by said temperature probe to a remote monitoring device;

(iv) thermal insulating means disposed around said tubular member; and (v) connecting means for detachably connecting said thermal insulating barrier to said insulating means;

(b) connecting output temperature signal from said temperature sensing device to display means;

(c) connecting output temperature signal from said temperature sensing device to recording means;

(d) monitoring said output temperature signal on said display means; and (e) recording output temperature signal from said temperature sensing device on recording means.

59. The method of monitoring temperature in said production process described in claim 58, wherein said conduit means is selected from the group comprising: a wellbore, a pipe, a manifold, a subsea piping, a surface piping, a subsea tree block, a subsea christmas tree, a spool, a riser, a flow line, and a blowout protector.

60. The method of monitoring temperature in said production process described in claim 58 wherein said production process comprises: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

61. The method of monitoring temperature in said production process described in claim 58, wherein said display means is a member of the group comprising: CRT display screen, liquid crystal display screen, printer, projection display screen, and combinations thereof.

62. The method of monitoring temperature in said production process described in claim 58, wherein the recording means is a member of the group comprising: magnetic media, printed media, optical media, electronic media, and combinations thereof.

63. The method of monitoring temperature in said production process described in claim 58, wherein said fluid flow comprises a particulate flow, liquid flow, gas flow, and a combination flow thereof.

64. The method of monitoring temperature in said production process described in claim 58, wherein said conduit means is selected from the group comprising: a wellbore, a pipe, a manifold, subsea piping, surface piping, a subsea tree block, a subsea christmas tree, a spool, a riser, flow line, and a blowout preventor.

65. The method of monitoring temperature in said production process described in claim 58 wherein said production process comprises of: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

66. The method of monitoring temperature in production process described in claim 58 wherein said signaling means is a member of the group comprising: electrically conductive wires, fiber optics, radio signals, acoustic signals, and combinations thereof.

67. A method of monitoring pressure in a production process comprising the steps of:

(a) providing a pressure sensor removably disposed in conduit means which provides fluid flow in said production process wherein said pressure sensing device further comprises;

(i) a temperature sensor capable of detecting temperature in said fluid flow comprising:

(1) a face having a surface roughness capable of providing turbulence to said fluid flow, wherein said face with surface roughness is made of thermally conductive material;

(2) a temperature probe in thermal connection with said face; and (3) a thermal insulating barrier surrounding said temperature probe and connected to said face, said thermal insulating barrier containing a passageway for providing signaling means;

(ii) a tubular member containing passageway continuing from said thermal insulating barrier for providing signaling means, said tubular member connected to said insulating barrier;

(iii) a pressure sensor capable of detecting pressure in said fluid flow comprising (iv) a pressure probe disposed on said face and in fluid connection with said fluid flow wherein said pressure probe is electrically insulated from said face;

(v) signaling means disposed in said passageway of said tubular member for communicating the temperature detected by said temperature probe and communicating the pressure detected by said pressure probe to a remote monitoring device;

(vi) thermal insulating means disposed around said tubular member; and (vii) connecting means for detachably connecting said face to said tubular member;

(b) connecting output pressure signal from said pressure sensor to display means;

(c) connecting output pressure signal from said pressure sensor to recording means;

(d) monitoring said output pressure signal on said display means; and (e) recording output pressure signal from said pressure sensor on recording means.

68. The method of monitoring pressure in production process described in claim 67 wherein the signaling means is a member of the group comprising: electrically conductive wires, fiber optics, radio signals, acoustic signals, and combinations thereof.

69. The method of monitoring pressure in said production process described in claim 67, wherein said conduit means is selected from the group comprising: a wellbore, a pipe, a manifold, a subsea piping, a surface piping, a subsea tree block, a subsea christmas tree, a spool, a riser, a flow line, and a blowout protector.

70. The method of monitoring pressure in said production process described in claim 67 wherein said production process comprises: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

71. The temperature and pressure sensing device described in claim 70, wherein said tubular member is stainless steel.

72. The temperature and pressure sensing device described in claim 70, wherein said tubular member is a stainless steel.

73. The method of monitoring pressure in said production process described in claim 67, wherein said display means is a member of the group comprising: CRT display screen, liquid crystal display screen, printer, projection display screen, and combinations thereof.

74. The method of monitoring pressure in said production process described in claim 67, wherein the recording means is a member of the group comprising: magnetic media, printed media, optical media, electronic media, and combinations thereof.

75. The method of monitoring pressure in said production process described in claim 67, wherein said fluid flow comprises of liquid, gas, or a combination thereof.

76. The method of monitoring pressure in said production process described in claim 67, wherein said conduit means is selected from the group comprising: a wellbore, a pipe, a manifold, subsea piping, surface piping, a subsea tree block, a subsea christmas tree, a spool, a riser, flow line, and a blowout preventor.

77. The method of monitoring pressure in said production process described in claim 67 wherein said production process comprises of: surface oil exploration, surface gas exploration, surface oil production, surface gas production, underwater oil exploration, underwater gas exploration, underwater oil production, underwater gas production, petroleum refinery operations, chemical manufacturing plants, fluid custody transfer systems, fluids in tank farm, and mixtures thereof.

* * * * *